US009564715B1

(12) United States Patent
Lin et al.

(10) Patent No.: US 9,564,715 B1
(45) Date of Patent: Feb. 7, 2017

(54) ELECTRICAL CONNECTOR

(71) Applicant: Cheng Uei Precision Industry Co., Ltd., New Taipei (TW)

(72) Inventors: Pei-Yi Lin, New Taipei (TW); Yi-Ching Hsu, New Taipei (TW); Kuo-Chin Lin, New Taipei (TW); Han-Wei Wang, New Taipei (TW); Sheng-Nan Yu, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/008,495

(22) Filed: Jan. 28, 2016

(51) Int. Cl.
*H01R 13/648* (2006.01)
*H01R 13/6581* (2011.01)
*H01R 24/60* (2011.01)

(52) U.S. Cl.
CPC ..... *H01R 13/6581* (2013.01); *H01R 24/60* (2013.01)

(58) Field of Classification Search
CPC ..... H01R 13/658; H01R 13/65802; H01R 23/6873; H01R 23/7073; H01R 23/7063
USPC ..... 439/607.04
See application file for complete search history.

(56) References Cited

U.S. PATENT DOCUMENTS 6,210,237 B1 * 4/2001 Chang ..... H01R 13/506 439/607.28
6,948,984 B2 * 9/2005 Chen ..... H01R 12/7088 439/607.01
7,575,454 B1 * 8/2009 Aoki ..... H01R 13/641 439/188
9,209,573 B1 * 12/2015 Chen ..... H01R 13/6581
9,214,765 B2 * 12/2015 Zheng ..... H01R 13/6581
9,214,766 B1 * 12/2015 Yu ..... H01R 13/6585
9,231,356 B1 * 1/2016 Ju ..... H01R 24/78
9,306,337 B2 * 4/2016 Yu ..... H01R 24/60
9,318,856 B2 * 4/2016 MacDougall ..... H01R 13/6581
9,331,433 B2 * 5/2016 Ueda ..... H01R 13/6581
9,350,121 B2 * 5/2016 Ju ..... H01R 13/6585
9,356,406 B2 * 5/2016 Yen ..... H01R 13/6581
9,425,560 B1 * 8/2016 Su ..... H01R 13/506
2013/0178094 A1 * 7/2013 Huang ..... H01R 24/60 439/490
2013/0189878 A1 * 7/2013 Lan ..... H01R 12/75 439/607.34
2015/0244110 A1 * 8/2015 Ju ..... H01R 13/6585 439/607.01
2015/0270646 A1 * 9/2015 Kao ..... H01R 13/6581 439/76.1
2015/0303623 A1 * 10/2015 Kao ..... H01R 13/6583 439/607.04

(Continued)

*Primary Examiner* — Abdullah Riyami
*Assistant Examiner* — Vladimir Imas
(74) *Attorney, Agent, or Firm* — Cheng-Ju Chiang

(57) ABSTRACT

An electrical connector includes a dielectric body, a plurality of terminals integrally molded to the dielectric body, an insulating housing, two shielding elements, and a shielding shell surrounding the dielectric body, the insulating housing and the shielding elements. The insulating housing has a top wall, a bottom wall, two side walls and a rear wall. A top surface of the top wall and a bottom surface of the bottom wall of the insulating housing are recessed inward to form two fastening cavities. The dielectric body together with the terminals is assembled to the insulating housing. The two shielding elements are fastened to the two fastening cavities, respectively.

12 Claims, 6 Drawing Sheets

(56) References Cited

U.S. PATENT DOCUMENTS

2015/0303629 A1* 10/2015 MacDougall ..... H01R 13/6581
439/607.01

* cited by examiner

ELECTRICAL CONNECTOR

BACKGROUND OF THE INVENTION

1. Field of the Invention

The present invention generally relates to an electrical connector, and more particularly to an electrical connector having a shielding function.

2. The Related Art

A crosstalk phenomenon will affect integrity of received signals, so terminals will have no way of receiving the correct signals to result in a misjudgment. Most common crosstalk noises are other people's words heard occasionally when two people are calling each other.

A conventional electrical connector includes an insulating housing, and a plurality of terminals and a shielding shell. The terminals are mounted to the insulating housing and arranged in two rows. The shielding shell surrounds the insulating housing together with the terminals. Because of phenomena of proximal and distal crosstalks of the conventional electrical connector, signals transmitted by the terminals will be mingled with interference signals to lower signal transmission qualities. When a size of the electrical connector for transmitting high-frequency signals is made smaller and smaller, the crosstalk phenomenon among the terminals will be more obvious.

However, a shielding function of the shielding shell shielding the terminals is weaker that makes the conventional electrical connector hardly decrease electromagnetic coupling of the high-frequency signals, so that signal interferences of the crosstalks are easily caused.

SUMMARY OF THE INVENTION

An object of the present invention is to provide an electrical connector. The electrical connector includes a dielectric body, a plurality of terminals, an insulating housing, two shielding elements and a shielding shell. Two opposite sides of a top surface of the dielectric body are recessed inward to form two recesses passing through a front surface of the dielectric body. Two opposite sides of a bottom surface of the dielectric body are recessed inward to form another two recesses passing through a front surface of the dielectric body. The terminals are integrally molded to the dielectric body and arranged in two rows along an up-down direction. Front ends of the terminals project beyond a front surface of the dielectric body. The insulating housing has a top wall, a bottom wall, two side walls and a rear wall. An insertion space is formed among the top wall, the bottom wall, the two side walls and the rear wall. A top surface of the top wall and a bottom surface of the bottom wall of the insulating housing are recessed inward to form two fastening cavities. Rear ends of the two side walls are spaced from each other to form an assembling opening between the rear ends of the two side walls. The dielectric body together with the terminals is assembled to the insulating housing. The dielectric body is assembled in the assembling opening. The front ends of the terminals partially project into the insertion space. The two shielding elements are fastened to the two fastening cavities, respectively. Each of the shielding elements has a fastening piece. Two opposite sides of a front edge of the fastening piece extend frontward to form a pair of elastic arms arched outward. Distal ends of the two elastic arms are connected with a connecting arm. Two opposite sides of a rear edge of the fastening piece extend rearward to form two extending arms. Two portions of a middle of the rear edge of the fastening piece slantwise extend rearward and outward to form two abutting portions. The fastening pieces, the elastic arms, the connecting arms and the two abutting portions of the two shielding elements are received in the two fastening cavities, respectively. The extending arms project into the respective recesses. The shielding shell surrounds the dielectric body, the insulating housing and the shielding elements. The abutting portions abut against an inner surface of the shielding shell.

As described above, the extending arms of the shielding elements are located between the terminals and the shielding shell, and the abutting portions abut against the inner surface of the shielding shell for realizing the ground function, a vertical distance between the terminals and each of the shielding elements is shorter than a vertical distance between the terminals and the shielding shell, so coupling between differential signals of each intra pair of the terminals of the electrical connector is enhanced, and coupling between signals of the terminals of the electrical connector and external signals is weakened, in this way, a shielding function of the electrical connector is enforced. As a result, signal interferences of crosstalks are effectively decreased.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
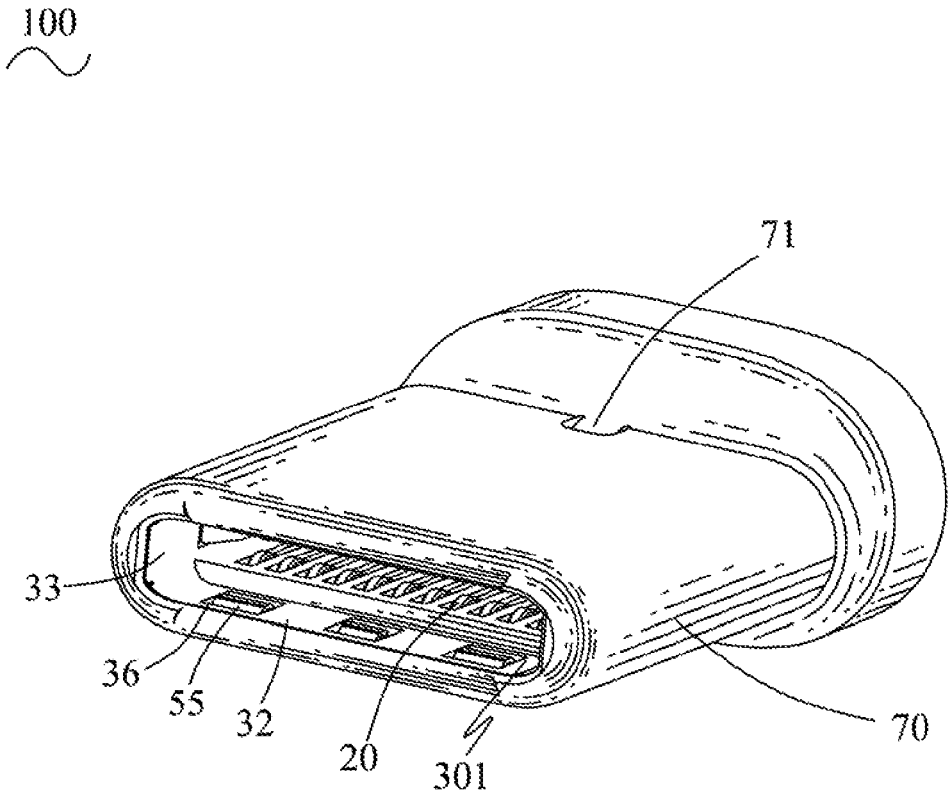
FIG. 1 is a perspective view of an electrical connector in accordance with an embodiment of the present invention.
Figure 2:
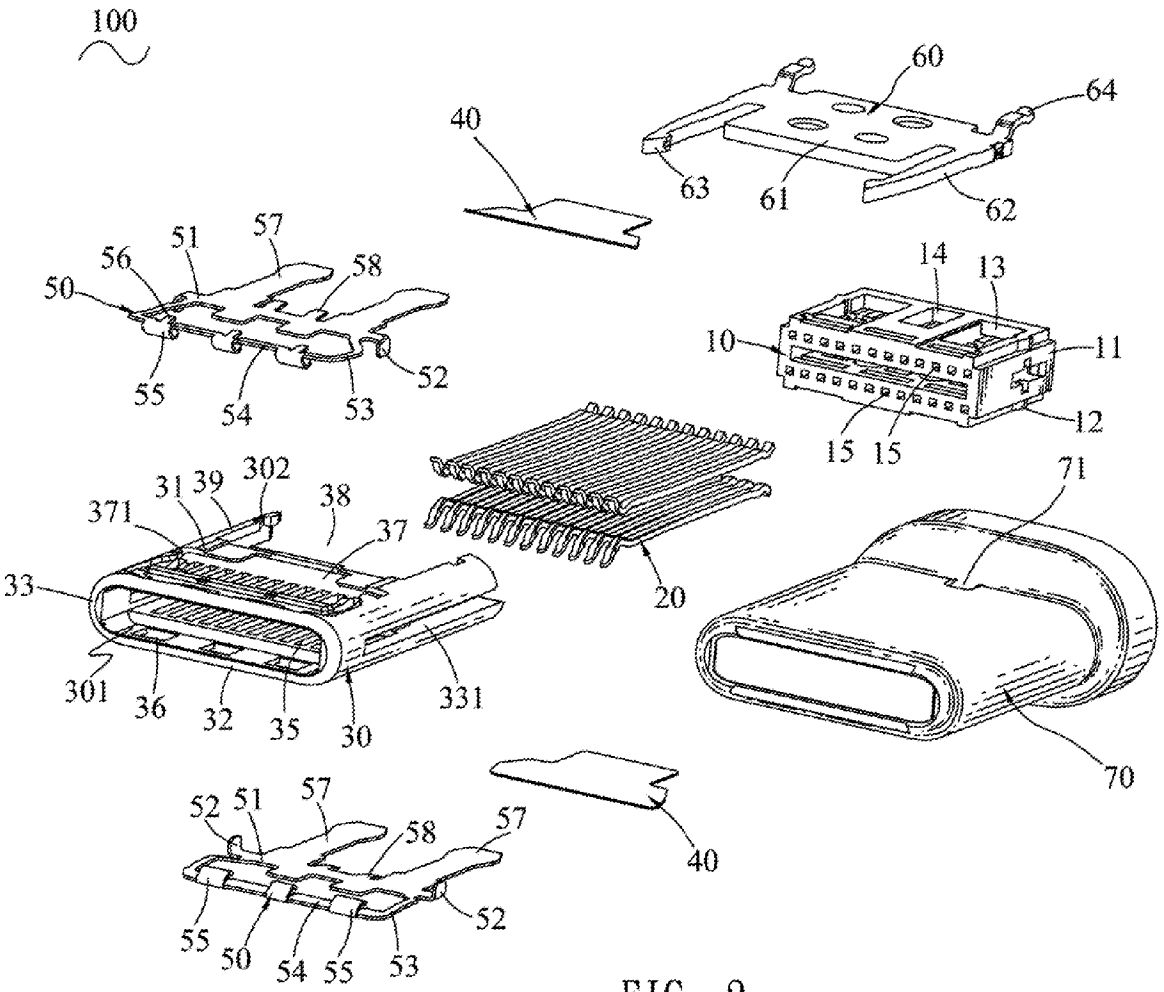
FIG. 2 is an exploded view of the electrical connector of FIG. 1.

With reference to FIG. 1 and FIG. 2, an electrical connector 100 in accordance with the present invention is shown. The electrical connector 100 includes a dielectric body 10, a plurality of terminals 20, an insulating housing 30, two insulation films 40, two shielding elements 50, a shielding plate 60 and a shielding shell 70.

Figure 5:
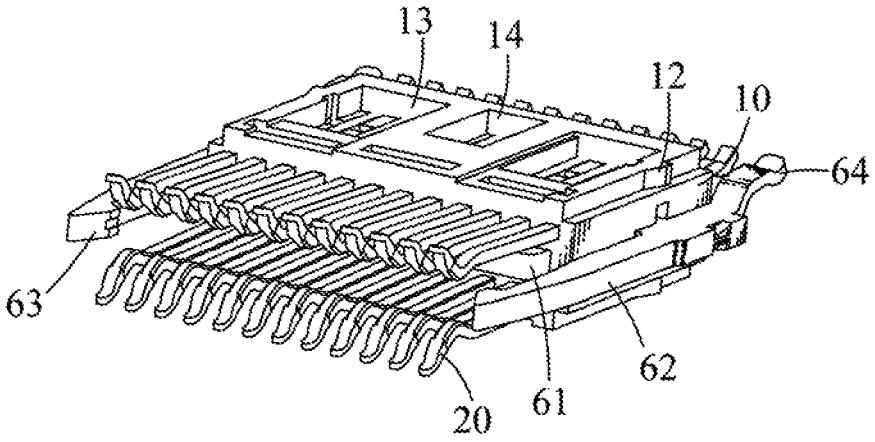
FIG. 5 is an assembling view of a dielectric body, terminals and a shielding plate of the electrical connector of FIG. 1.

Referring to FIG. 2 and FIG. 5, several portions of two opposite sides of the dielectric body 10 protrude outward to form a plurality of restricting blocks 12. Two opposite sides of a top surface of the dielectric body 10 are recessed inward to form two recesses 13 passing through a front surface of the dielectric body 10. Two opposite sides of a bottom surface of the dielectric body 10 are recessed inward to form another two recesses 13 passing through a front surface of the dielectric body 10. Middles of the top surface and the bottom surface of the dielectric body 10 are concaved inward to form two blocking grooves 14. The dielectric body 10 defines a plurality of fixing grooves 15 longitudinally penetrating through the dielectric body 10 and arranged in two rows along an up-down direction. The two rows of the fixing grooves 15 include an upper row of the fixing grooves 15, and a lower row of the fixing grooves 15 located under the upper row of the fixing grooves 15. The upper row of the fixing grooves 15 longitudinally penetrate through an upper portion of the dielectric body 10 and are arranged transversely. The lower row of the fixing grooves 15 longitudinally penetrate through a lower portion of the dielectric body 10 and are arranged transversely.

Figure 6:
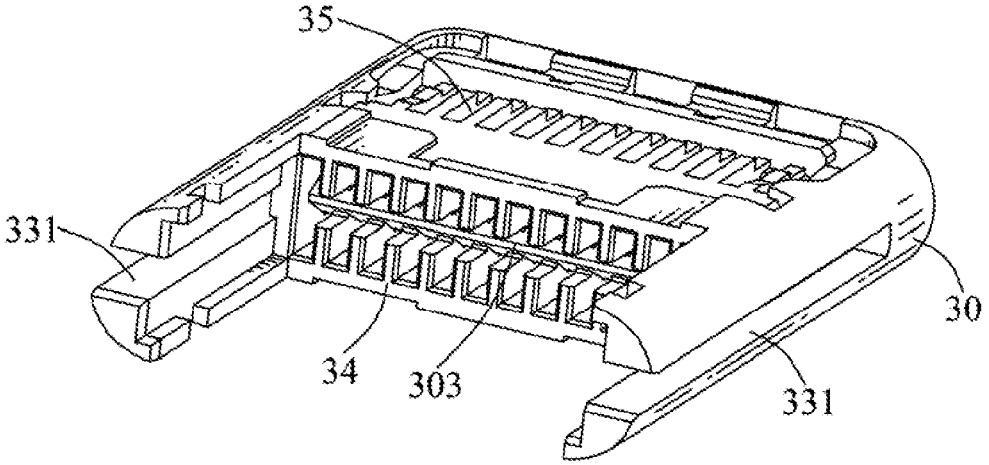
FIG. 6 is a perspective view of an insulating housing of the electrical connector of FIG. 1.

Referring to FIG. 2, FIG. 5 and FIG. 6, the terminals 20 are integrally molded to the dielectric body 10 and arranged in two rows along the up-down direction. Middle portions of the terminals 20 are molded in the dielectric body 10. Front ends of the terminals 20 project beyond a front surface of the dielectric body 10. Rear ends of the terminals 20 project beyond a rear surface of the dielectric body 10. The two rows of the terminals 20 include an upper row of the terminals 20, and a lower row of the terminals 20 located under the upper row of the terminals 20. The upper row of the terminals 20 are molded to the upper portion of the dielectric body 10 and arranged transversely. The lower row of the terminals 20 are molded to the lower portion of the dielectric body 10 and arranged transversely. The upper row of the terminals 20 and the lower row of the terminals 20 are molded to the dielectric body 10, respectively. The upper row of the terminals 20 are molded to the upper row of the fixing grooves 15. The lower row of the terminals 20 are molded to the lower row of the fixing grooves 15.

Referring to FIG. 2 and FIG. 6, the insulating housing 30 has a top wall 31, a bottom wall 32, two side walls 33 and a rear wall 34. Front ends of the two side walls 33 are connected between the top wall 31 and the bottom wall 32. The rear wall 34 is connected with rear ends of the top wall 31 and the bottom wall 32, and middles of the two side walls 33. An insertion space 301 is formed among the top wall 31, the bottom wall 32, the front ends of the two side walls 33 and the rear wall 34. The insulating housing 30 defines two rows of terminal grooves 35 along the up-down direction. The two rows of terminal grooves 35 include an upper row of the terminal grooves 35, and a lower row of the terminal grooves 35 located under the upper row of the terminal grooves 35. Front ends of the upper row of the terminal grooves 35 penetrate through the top wall 31 of the insulating housing 30. Rear ends of the upper row of the terminal grooves 35 penetrate through an upper portion of the rear wall 34. The upper row of the terminal grooves 35 are arranged transversely. Front ends of the lower row of the terminal grooves 35 penetrate through the bottom wall 32 of the insulating housing 30. Rear ends of the lower row of the terminal grooves 35 penetrate through a lower portion of the rear wall 34. The lower row of the terminal grooves 35 are arranged transversely. Front ends of the top wall 31 and the bottom wall 32 of the insulating housing 30 define at least one buckling hole 36. A middle of the rear wall 34 of the insulating housing 30 is recessed frontward to form a fastening slot 303 extending transversely.

A top surface of the top wall 31 and a bottom surface of the bottom wall 32 of the insulating housing 30 are recessed inward to form two fastening cavities 37. One of the fastening cavities 37 in the top wall 31 is communicated with the upper row of the terminal grooves 35 and the buckling holes 36 of the top wall 31. The other fastening cavity 37 in the bottom wall 32 is communicated with the lower row of the terminal grooves 35 and the buckling holes 36 of the bottom wall 32. Two opposite sides of an inner wall of each of the fastening cavities 37 define two insertion holes 371. Rear ends of the two side walls 33 are spaced from each other to form an assembling opening 38 between the rear ends of the two side walls 33. The two side walls 33 of the insulating housing 30 open two clamping grooves 331 respectively penetrating through rear surfaces of the two side walls 33 of the insulating housing 30. The two clamping grooves 331 transversely penetrate through middles of the two side walls 33, respectively. Front ends of the two clamping grooves 331 are communicated with the insertion space 301. Rear ends of the two clamping grooves 331 are communicated with the assembling opening 38. An upper side and a lower side of each side wall of the assembling opening 38 extend inward to form a pair of guide rails 39 for guiding the dielectric body 10. Each of the guide rails 39 defines a restricting groove 302.

Referring to FIG. 2, each of the shielding elements 50 has a fastening piece 51. Two opposite sides of the fastening piece 51 are bent inward and perpendicular to the fastening piece 51 to form two insertion arms 52. Two opposite sides of a front edge of the fastening piece 51 extend frontward to form a pair of elastic arms 53 arched outward. Each of the elastic arms 53 is extended frontward from the front edge of the fastening piece 51 and arched outward to show an arch-shape. Distal ends of the two elastic arms 53 are connected with a connecting arm 54. A front end of a portion of the connecting arm 54 is curved inward and rearward, and then arched inward to form a contact portion 55. A rear end of the portion of the connecting arm 54 forms a ground portion 56 extending rearward and inclining outward. The ground portion 56 is corresponding to the contact portion 55. Two opposite sides of a rear edge of the fastening piece 51 extend rearward to form two extending arms 57. Two portions of a middle of the rear edge of the fastening piece 51 slantwise extend rearward and outward to form two abutting portions 58.

Figure 3:
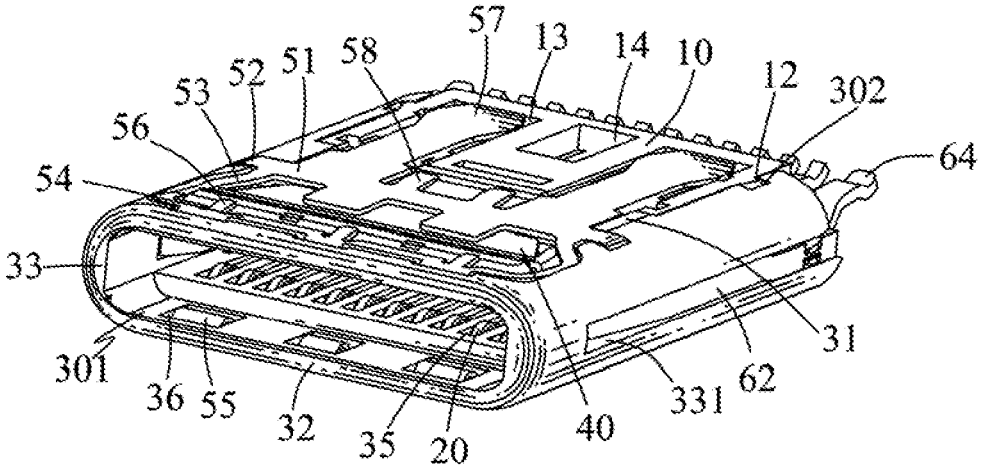
FIG. 3 is a partially perspective view of the electrical connector of FIG. 1, wherein a shielding shell is omitted.
Figure 4:
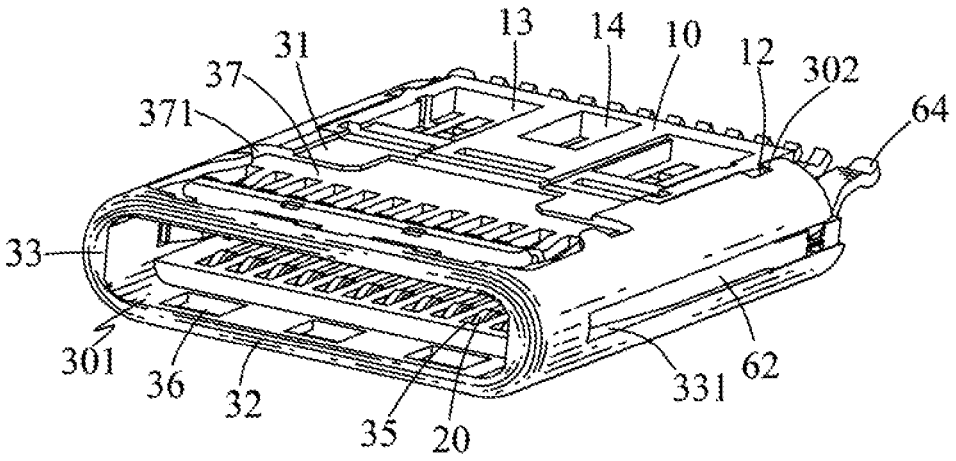
FIG. 4 is another partially perspective view of the electrical connector of FIG. 1, wherein the shielding shell, the two insulation films and the two shielding elements are omitted.

Referring to FIG. 2, FIG. 3 and FIG. 4, the shielding plate 60 is integrally molded to the dielectric body 10 and located between the two rows of terminals 20. The shielding plate 60 has a main plate 61 disposed horizontally. Two opposite sides of the main plate 61 protrude outward and then extend frontward to form two clamping arms 62. Inner surfaces of the two clamping arms 62 protrude face to face to form two clamping portions 63. Rear edges of the two clamping arms 62 slantwise extend rearward to form two soldering arms 64. The main plate 61 is molded in the dielectric body 10. A front end of the main plate 61 projects beyond a front surface of the dielectric body 10. The two clamping arms 62 project beyond two side surfaces of the dielectric body 10, respectively. The two soldering arms 64 project beyond the two side surfaces of the dielectric body 10, respectively.

Referring to FIG. 1 and FIG. 2, the shielding shell 70 is of a substantially rectangular tube shape. A top and a bottom of the shielding shell 70 are punched inward to form two blocking pieces 71 corresponding to the blocking grooves 14.

Referring to FIG. 1 to FIG. 6, in assembly, the dielectric body 10 together with the terminals 20 and the shielding plate 60 is assembled frontward to the insulating housing 30. The front end of the main plate 61 is fastened in the fastening slot 303. The dielectric body 10 is assembled in the assembling opening 38. Each of the restricting blocks 12 is restricted in the restricting groove 302 for preventing the dielectric body 10 breaking away from the insulating housing 30. The front ends of the terminals 20 are received in the terminal grooves 35 and partially project into the insertion space 301. The rear ends of the terminals 20 project out of the insulating housing 30. The two clamping arms 62 are received in the clamping grooves 331. The two clamping portions 63 project into the insertion space 301 of the insulating housing 30. The soldering arms 64 project out of the insulating housing 30. The electrical connector 100 is matched with a butting connector (not shown). The butting connector (not shown) is inserted into the insertion space 301 of the insulating housing 30. The two clamping portions 63 clamp the butting connector.

The two insulation films 40 are mounted to the top wall 31 and the bottom wall 32 of the insulating housing 30, respectively. Specifically, the insulation films 40 are respectively mounted to the two fastening cavities 37 and cover the front ends of the terminals 20. The two shielding elements 50 are mounted to the top wall 31 and the bottom wall 32 of the insulating housing 30, respectively. The two shielding elements 50 are fastened to the two fastening cavities 37, respectively. The two shielding elements 50 cover the two insulation films 40, respectively. The fastening pieces 51, the elastic arms 53, the connecting arms 54 and the two abutting portions 58 of the two shielding elements 50 are received in the two fastening cavities 37, respectively. The two insertion arms 52 of each of the shielding elements 50 are inserted into the two insertion holes 371, respectively for fastening each of the shielding elements 50 firmly. The contact portion 55 is received in the buckling hole 36 and projects into the insertion space 301.

The extending arms 57 project rearward into the respective recesses 13. The extending arms 57 of the shielding elements 50 are located between the terminals 20 and the shielding shell 70. The ground portions 56 and the abutting portions 58 of the two shielding elements 50 project beyond the top surface of the top wall 31 and the bottom surface of the bottom wall 32, respectively. Each of the insulation films 40 is clamped between the terminals 20 and one of the shielding elements 50. The insulation films 40 are capable of effectively preventing the terminals 20 contacting with the shielding elements 50 for ensuring a better electrical performance of the electrical connector 100.

The shielding shell 70 surrounds the dielectric body 10, the insulating housing 30 and the shielding elements 50. The abutting portions 58 abut against an inner surface of the shielding shell 70 for realizing a ground function. The ground portions 56 contact with the shielding shell 70 in the process of the butting connector being inserted into the insertion space 301 of the electrical connector 100 for enforcing the ground function. The blocking pieces 71 are blocked in the blocking grooves 14 for preventing the shielding shell 70 falling off.

As described above, the extending arms 57 of the shielding elements 50 are located between the terminals 20 and the shielding shell 70, and the abutting portions 58 abut against the inner surface of the shielding shell 70 for realizing the ground function, a vertical distance between the terminals 20 and each of the shielding elements 50 is shorter than a vertical distance between the terminals 20 and the shielding shell 70, so coupling between differential signals of each intra pair of the terminals 20 of the electrical connector 100 is enhanced, and coupling between signals of the terminals 20 of the electrical connector 100 and external signals is weakened, in this way, a shielding function of the electrical connector 100 is enforced. As a result, signal interferences of crosstalks are effectively decreased.

What is claimed is:

1. An electrical connector, comprising:

a dielectric body, two opposite sides of a top surface of the dielectric body being recessed inward to form two recesses passing through a front surface of the dielectric body, two opposite sides of a bottom surface of the dielectric body being recessed inward to form another two recesses passing through a front surface of the dielectric body;

a plurality of terminals integrally molded to the dielectric body and arranged in two rows along an up-down direction, front ends of the terminals projecting beyond a front surface of the dielectric body;

an insulating housing having a top wall, a bottom wall, two side walls and a rear wall, an insertion space being formed among the top wall, the bottom wall, the two side walls and the rear wall, a top surface of the top wall and a bottom surface of the bottom wall of the insulating housing being recessed inward to form two fastening cavities, rear ends of the two side walls being spaced from each other to form an assembling opening between the rear ends of the two side walls, the dielectric body together with the terminals being assembled to the insulating housing, the dielectric body being assembled in the assembling opening, the front ends of the terminals partially projecting into the insertion space;

two shielding elements fastened to the two fastening cavities, respectively, each of the shielding elements having a fastening piece, two opposite sides of a front edge of the fastening piece extending frontward to form a pair of elastic arms arched outward, distal ends of the two elastic arms being connected with a connecting arm, two opposite sides of a rear edge of the fastening piece extending rearward to form two extending arms, two portions of a middle of the rear edge of the fastening piece slantwise extending rearward and outward to form two abutting portions, the fastening pieces, the elastic arms, the connecting arms and the two abutting portions of the two shielding elements being received in the two fastening cavities, respectively, the extending arms projecting into the respective recesses; and a shielding shell surrounding the dielectric body, the insulating housing and the shielding elements, the abutting portions abutting against an inner surface of the shielding shell.

2. The electrical connector as claimed in claim 1, wherein front ends of the top wall and the bottom wall of the insulating housing define at least one buckling hole, a front end of a portion of the connecting arm is curved inward and rearward, and then arched inward to form a contact portion, the contact portion is received in the buckling hole and projects into the insertion space.

3. The electrical connector as claimed in claim 2, wherein a rear end of the portion of the connecting arm forms a ground portion extending rearward and inclining outward, the ground portion is corresponding to the contact portion, the ground portions contact with the shielding shell in the process of a butting connector being inserted into the insertion space.

4. The electrical connector as claimed in claim 1, wherein two opposite sides of an inner wall of each of the fastening cavities define two insertion holes, two opposite sides of the fastening piece are bent inward and perpendicular to the fastening piece to form two insertion arms, the two insertion arms of each of the shielding elements are inserted into the two insertion holes, respectively.

5. The electrical connector as claimed in claim 1, further comprising a shielding plate integrally molded to the dielectric body and located between the two rows of terminals, the shielding plate having a main plate disposed horizontally, two opposite sides of the main plate protruding outward and then extending frontward to form two clamping arms, inner surfaces of the two clamping arms protruding face to face to form two clamping portions, rear edges of the two clamping arms slantwise extending rearward to form two soldering arms, the main plate being molded in the dielectric body, the two clamping arms projecting beyond two side surfaces of the dielectric body, respectively, the two soldering arms projecting beyond the two side surfaces of the dielectric body, respectively, the two side walls of the insulating housing opening two clamping grooves respectively penetrating through rear surfaces of the two side walls of the insulating housing, the two clamping arms being received in the clamping grooves, the two clamping portions projecting into the insertion space.

6. The electrical connector as claimed in claim 5, wherein a middle of the rear wall of the insulating housing is recessed frontward to form a fastening slot extending transversely, a front end of the main plate projects beyond a front surface of the dielectric body, the front end of the main plate is fastened in the fastening slot.

7. The electrical connector as claimed in claim 1, wherein the insulating housing defines two rows of terminal grooves along the up-down direction, middle portions of the terminals are molded in the dielectric body, rear ends of the terminals project beyond a rear surface of the dielectric body, the front ends of the terminals are received in the terminal grooves, the rear ends of the terminals project out of the insulating housing.

8. The electrical connector as claimed in claim 1, wherein several portions of two opposite sides of the dielectric body protrude outward to form a plurality of restricting blocks, an upper side and a lower side of each side wall of the assembling opening extend inward to form a pair of guide rails, each of the guide rails defines a restricting groove, each of the restricting blocks is restricted in the restricting groove.

9. The electrical connector as claimed in claim 1, wherein middles of the top surface and the bottom surface of the dielectric body are concaved inward to form two blocking grooves, a top and a bottom of the shielding shell are punched inward to form two blocking pieces, the blocking pieces are blocked in the blocking grooves.

10. The electrical connector as claimed in claim 1, further comprising two insulation films, the two insulation films being mounted to the top wall and the bottom wall of the insulating housing, respectively.

11. The electrical connector as claimed in claim 10, wherein the insulation films are respectively mounted to the two fastening cavities and cover the front ends of the terminals, each of the insulation films is clamped between the terminals and one of the shielding elements.

12. The electrical connector as claimed in claim 1, wherein each of the elastic arms is extended frontward from the front edge of the fastening piece and arched outward to show an arch-shape.

* * * * *